US011608563B2

(12) United States Patent
Keigler et al.

(10) Patent No.: US 11,608,563 B2
(45) Date of Patent: Mar. 21, 2023

(54) ELECTROCHEMICAL DEPOSITION SYSTEMS

(71) Applicant: ASMPT NEXX, INC., Billerica, MA (US)

(72) Inventors: Arthur Keigler, Billerica, MA (US); Dave Guarnaccia, Billerica, MA (US); Demetrius Papapanaiyatou, Billerica, MA (US); Jon Hander, Billerica, MA (US); Robert Moon, Billerica, MA (US)

(73) Assignee: ASMPT NEXX, INC., Billerica, MA (US)

( * ) Notice: Subject to any disclaimer, the term of this patent is extended or adjusted under 35 U.S.C. 154(b) by 519 days.

(21) Appl. No.: 16/516,714

(22) Filed: Jul. 19, 2019

(65) Prior Publication Data

US 2021/0017661 A1 Jan. 21, 2021

(51) Int. Cl.

| | |
|---|---|
| ***C25D 5/08*** | (2006.01) |
| ***C25D 17/00*** | (2006.01) |
| ***C25D 5/02*** | (2006.01) |
| ***C25D 21/10*** | (2006.01) |
| ***C25D 17/06*** | (2006.01) |

(52) U.S. Cl.

CPC ..... *C25D 5/08* (2013.01); *C25D 5/02* (2013.01); *C25D 17/001* (2013.01); *C25D 17/008* (2013.01); *C25D 17/06* (2013.01); *C25D 21/10* (2013.01)

(58) Field of Classification Search

CPC ..... C25C 5/02; C25C 5/08; C25C 17/001; C25C 17/008; C25C 21/10; C25D 5/02; C25D 5/08; C25D 17/001; C25D 17/008; C25D 21/10; C25D 17/006

See application file for complete search history.

(56) References Cited

U.S. PATENT DOCUMENTS

| | | | | |
|---|---|---|---|---|
| 7,445,697 | B2 | 11/2008 | Keigler et al. | 204/297.01 |
| 9,631,294 | B2 | 4/2017 | Weinhold et al. | |
| 9,816,194 | B2 | 11/2017 | He et al. | |
| 10,014,170 | B2 | 7/2018 | Kagajwala et al. | |
| 10,240,248 | B2 | 3/2019 | Van Valkenburg et al. | |
| 2005/0167275 | A1 | 8/2005 | Keigler et al. | 205/96 |
| 2006/0283710 | A1* | 12/2006 | Cohen | C25D 1/003 205/118 |
| 2012/0199475 | A1 | 8/2012 | McHugh et al. | 204/273 |
| 2012/0298502 | A1* | 11/2012 | Papapanayiotou | C25D 17/002 204/237 |
| 2012/0305404 | A1 | 12/2012 | Keigler | 205/96 |

(Continued)

*Primary Examiner* — Ciel P Contreras

(74) *Attorney, Agent, or Firm* — Ostrolenk Faber LLP

(57) ABSTRACT

An electrochemical deposition system for depositing metal onto a workpiece, comprises a deposition chamber adapted to receive plating solution, a workpiece holder for holding a workpiece in a first plane, a shield holder for holding a shield in a second plane substantially parallel to the first plane, an agitation plate having a profiled surface to agitate plating solution, wherein the workpiece holder, shield holder and agitation plate are all adapted for insertion into and removal from the deposition chamber, and further comprising an actuator operable to change a relative distance between the workpiece holder and shield holder, in a direction normal to the first and second planes, while they are located within the deposition chamber.

17 Claims, 19 Drawing Sheets

(56) References Cited

U.S. PATENT DOCUMENTS

| | | | | |
|---|---|---|---|---|
| 2017/0101722 | A1* | 4/2017 | Gao | C25D 3/56 |
| 2017/0191180 | A1* | 7/2017 | Bergman | C25D 21/10 |
| 2017/0370017 | A1 | 12/2017 | Keigler et al. | |
| 2020/0392641 | A1* | 12/2020 | Hirao | C25D 17/02 |

* cited by examiner

ELECTROCHEMICAL DEPOSITION SYSTEMS

BACKGROUND AND PRIOR ART

As interconnection feature dimensions on workpieces such as wafers, in particular semiconductor wafers, characterized by relatively rigid silicon circular disks, or panels, characterized by much larger and more flexible rectangular shaped substrates, used for advanced packaging shrink, and as electrical requirements tighten, there are a number of applications for which the spatial and thickness uniformity is particularly critical. This invention pertains to electrochemical deposition (ECD) of metals in a precise pattern for such applications. Hereafter, the term "workpiece" will be used to encompass such wafers, panels and substrates suitable for ECD processes.

FIG. 1 schematically shows a known ECD system 500 for depositing metal onto a substrate, which is described in detail in US2017/0370017. The ECD system 500 includes two or more processing modules, to be described below, including at least one ECD module, arranged on a common platform and configured for depositing one or more metals onto a workpiece. Each ECD module includes an anode compartment configured to contain a volume of anolyte fluid, a cathode compartment configured to contain a volume of catholyte fluid, and a membrane separating the anode compartment from the cathode compartment. The ECD system 500 has a loading port to receive a set of workpieces, including a loader module 510 for receiving the workpieces that enter ECD system 500 through load/input stage 512 and loading each received workpiece into a workpiece holder 525, such as a flexible panel holder (PH).

System 500 includes a transportation mechanism configured to transport flexible workpieces, via workpiece holder 525, from the loader module 510 to a given processing module, e.g., an ECD module, and lower a given workpiece into the given processing module. For example, once the workpiece holder 525, designated for processing, is loaded, it can proceed along a process path 515 (see PH process path) to be pre-processed, as needed, in one or more pre-processing modules 520; processed in one or more processing modules 530, 532, 534, 536, 538; and post-processed, as needed, in one or more post-processing modules 540. Pre-processing may include for example cleaning and/or wetting the workpiece to be processed. Processing may include for example depositing material, such as metal, onto the workpiece. Post-processing meanwhile may include for example rinsing and/or drying the workpiece.

An unloader module 550 is configured to remove the flexible workpiece from the workpiece holder and convey the flexible workpiece to an unloading port 552 configured to receive the set of flexible workpieces. Once unloaded, the workpiece holder 525 can return to the loader module 510 along return path 555 (see PH return path) to receive another workpiece. Multiple workpiece holders can be used, with some workpiece holders held in a storage buffer.

The ECD system 500 further includes a chemical management system 560 for managing processing fluid in the one or more processing cells, i.e., modules 520, 530, 532, 534, 536, 538, 540. Chemical management may include, but not be limited to, supplying, replenishing, dosing, heating, cooling, circulating, recirculating, storing, monitoring, draining, abating, etc. System 500 also includes an electrical management system 570, which can transmit and receive signals in accordance with computer encoded instructions to control workpiece movement through the ECD system 500, or control chemical properties, such as chemical composition, temperature, flow rate(s), etc., of the plural modules 520, 530, 532, 534, 536, 538, 540. Additionally, the electrical management system 570 can be configured to apply an electrical current to one or both opposing planar surfaces of the flexible workpiece when held within the given ECD module. In doing so, one or both opposing surfaces can be plated with metal and blind holes and/or through-holes are filled with metal.

FIG. 2 schematically shows a perspective view of such an ECD system. The ECD system 500 includes loader module 510 and unloader module 550 with plural modules 520, 530, 540 disposed therebetween. While the loader module 510 and the unloader module 550 are shown to be at distal ends of the ECD system 500, these loading and unloading modules may be arranged proximate the same end of the overall system. Workpiece W can be loaded into workpiece holder 525, translated via workpiece transfer system 560, and oriented for positioning within the plural modules 520, 530, 540.

As is understood in the art, dielectric shields with open areas disposed between the anode and the cathode or workpiece are used in ECD to modify globally the electric field near the workpiece, thereby modifying the deposition current for uniformity control, for example to compensate for the terminal effect or other one-dimensional plating effect.

An example of such a shield 100, which is known from U.S. Pat. No. 7,445,697, is schematically shown in FIG. 3. The shield 100 here includes an outer ring 114 which intercepts the electric field near the workpiece edge in use. The outer ring 114 includes fastening holes 112 for connecting the shield to a housing (not shown) within the plating module (not shown). These bolts align the outer ring 114 with the circular workpiece (not shown) during plating. A substantially planar body 120 of the shield 100, within outer ring 114, defines a plurality of apertures 116. The apertures 116 can have a distribution of sizes, for example and as shown in FIG. 3, the apertures 116 grow larger in diameter toward the center of the shield 100. Both the aperture pattern in the shield 100 and the inner diameter of ring 114 may depend on the size of the workpiece (a shield such as shield 100 may typically extend the full span of the workpiece), the "bath conductivity" (i.e. the conductivity of plating solution within a deposition chamber), the plating rate or some other global parameter, but not on details of the workpiece pattern, for example at the millimeter scale.

Such shields are generally positioned far from the workpiece, at a distance significantly greater than the spacing between the holes. FIG. 4 schematically shows, in sectional view, the shield 100 and a portion of a workpiece 101. The apertures 116 of shield 100 are spaced at a pitch H. A region 106 of the workpiece 101 contains interconnection features. The features can for example be bumps, pillars, vias, redistribution layers, etc. The features may be uniform or non-uniform. The region 106 may contain at least one sub-region with a high current density also known as a high plateable area, and/or at least one sub-region which is sparsely populated with only a few interconnection features and a low plateable area.

The facing surfaces of shield 100 and workpiece 101 are separated by a gap distance G. The uniformity of plating in region 106 is related to the ratio of gap G to aperture pitch H. The ratio of G/H shown in FIG. 4 is 3:1. Simulations and experimental measurements have shown that in order to achieve acceptable plating uniformity in region 106, the ratio G/H needs to be 3:1 or greater. The uniformity of deposition in region 106 will depend on a number of factors, such as the photoresist-opening pattern density. If sparse and dense patterns both exist, an effect called "current crowding" may cause higher deposition rates in the sparse areas. The effect is especially strong near the boundaries between areas of photoresist-opening pattern density and areas of pure photoresist.

It can be seen that the hole pattern in the far uniformity shields (FUS) shown in FIGS. 3 and 4 are not related to the desired plating pattern on a workpiece.

Other prior art, which include background information on aspects of ECD systems, fluid agitation and prior art far uniformity shields include: US2005/0167275, US2012/0305404, US2012/0199475, U.S. Pat. Nos. 9,631,294, 9,816,194, 10,014,170, and 10,240,248.

Applicant proposes that an alternative form of shield which in use is sufficiently close to the workpiece to allow uniformity control on the length scale of feature patterning would have advantages for applications requiring tight uniformity control. Such a shield would have a pattern of openings which is designed specifically for use with a particular workpiece pattern.

There are however a number of difficulties to implementing such a "close patterning shield" (CPS) in an ECD system. For example, some ECD systems rotate the workpiece in order to agitate and distribute fluid at the workpiece surface. It is difficult to implement a CPS in such a system because alignment of the shield with the workpiece requires the shield to be rotated in tandem with the workpiece. The plating fluid between the shield and workpiece in such a system would also rotate, reducing the fluid agitation at the substrate surface, limiting mass transport of reactant species, and causing unacceptably low plating rates.

Also, some ECD systems hold the workpiece stationary and use paddles or agitation plates for fluid agitation. In such systems, it is difficult to mount and hold precise alignment between a close patterning shield and a workpiece due to the effects of fluid agitation.

Furthermore, because a close patterning shield is designed for use with a particular workpiece pattern, it needs to be replaced each time a workpiece with a new pattern is to be plated. Replacing and realigning of a shield is generally a complex task which requires reconnection and realignment of the agitation motion drive system. The need to connect and align the drive system may reduce system availability.

The present invention seeks to provide an ECD system which provides sufficient agitation to a workpiece, maintains precise alignment between a close patterning shield and the workpiece, and in which the shield can be replaced with minimal loss of system availability.

In accordance with the present invention this aim is achieved firstly by an ECD system which allows a workpiece and shield to be relatively moved while located in a deposition chamber, and secondly by providing components to be inserted into a deposition chamber within a modular cartridge, greatly aiding placement and replacement of those components.

SUMMARY OF THE INVENTION

In accordance with a first aspect of the present invention there is provided an electrochemical deposition system for depositing metal onto a workpiece, comprising:

a deposition chamber adapted to receive plating solution in use, a workpiece holder for holding a workpiece in a first plane, a shield holder for holding a shield in a second plane substantially parallel to the first plane, an agitation plate having a profiled surface to agitate plating solution in use, wherein the workpiece holder, shield holder and agitation plate are all adapted for insertion into and removal from the deposition chamber, and wherein the electrochemical deposition system further comprises an actuator operable to change a relative distance between the workpiece holder and shield holder, in a direction normal to the first and second planes, while they are located within the deposition chamber.

In accordance with a second aspect of the present invention there is provided a cartridge for use in an electrochemical deposition system for depositing target material onto a workpiece, comprising:

an agitation plate having a profiled surface to agitate a liquid in use, and a shield holder for holding a shield.

In accordance with a third aspect of the present invention there is provided a system for electrochemical deposition comprising the cartridge of the second aspect.

Other specific aspects and features of the present invention are set out in the accompanying claims.

BRIEF DESCRIPTION OF THE DRAWINGS

The invention will now be described with reference to the accompanying drawings (not to scale), in which.

DETAILED DESCRIPTION OF THE PREFERRED EMBODIMENTS OF THE INVENTION

Figure 1:
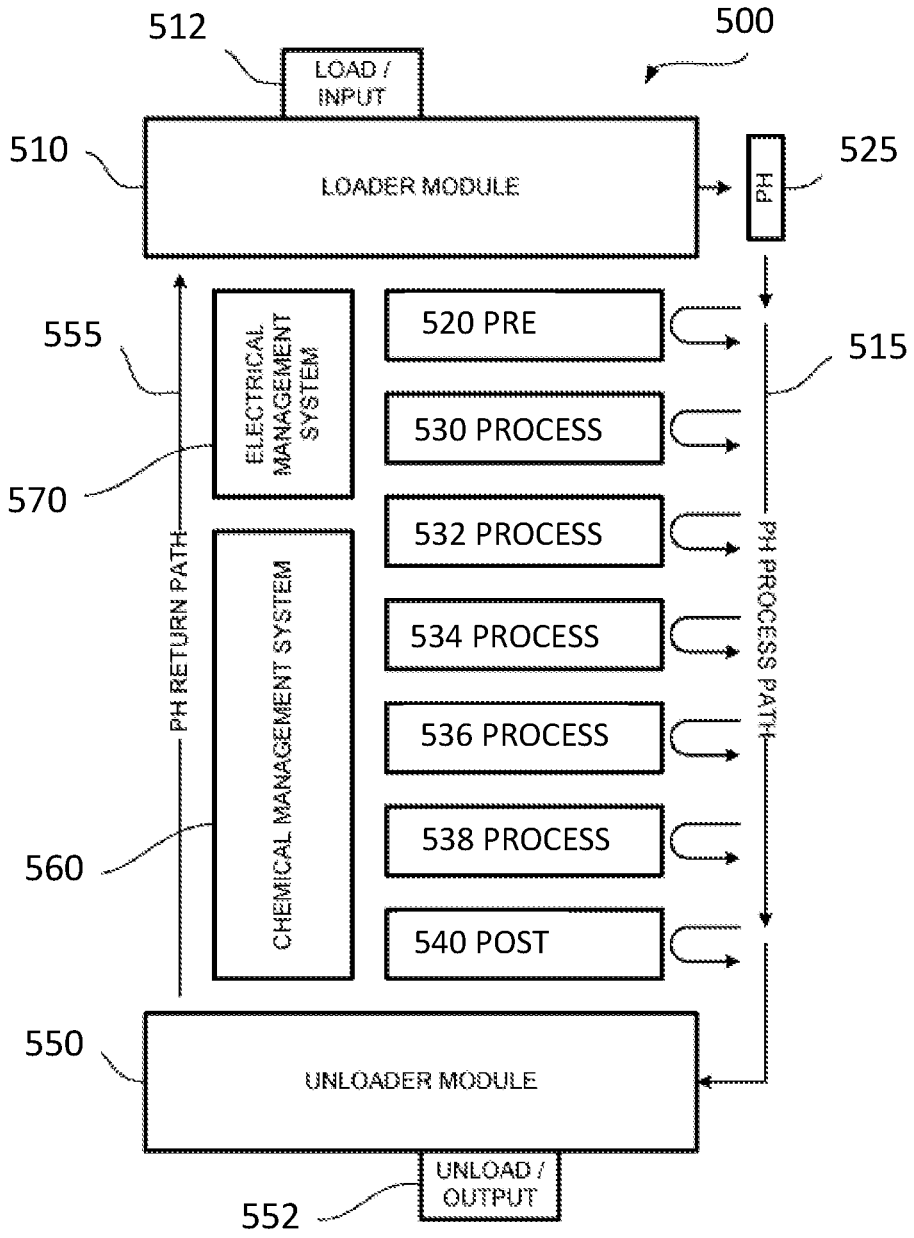
FIG. 1 (Prior art)
FIG. 1 schematically shows a known ECD system.

For consistency and clarity, like reference numerals will be retained for like components throughout the following description.

Figure 2:
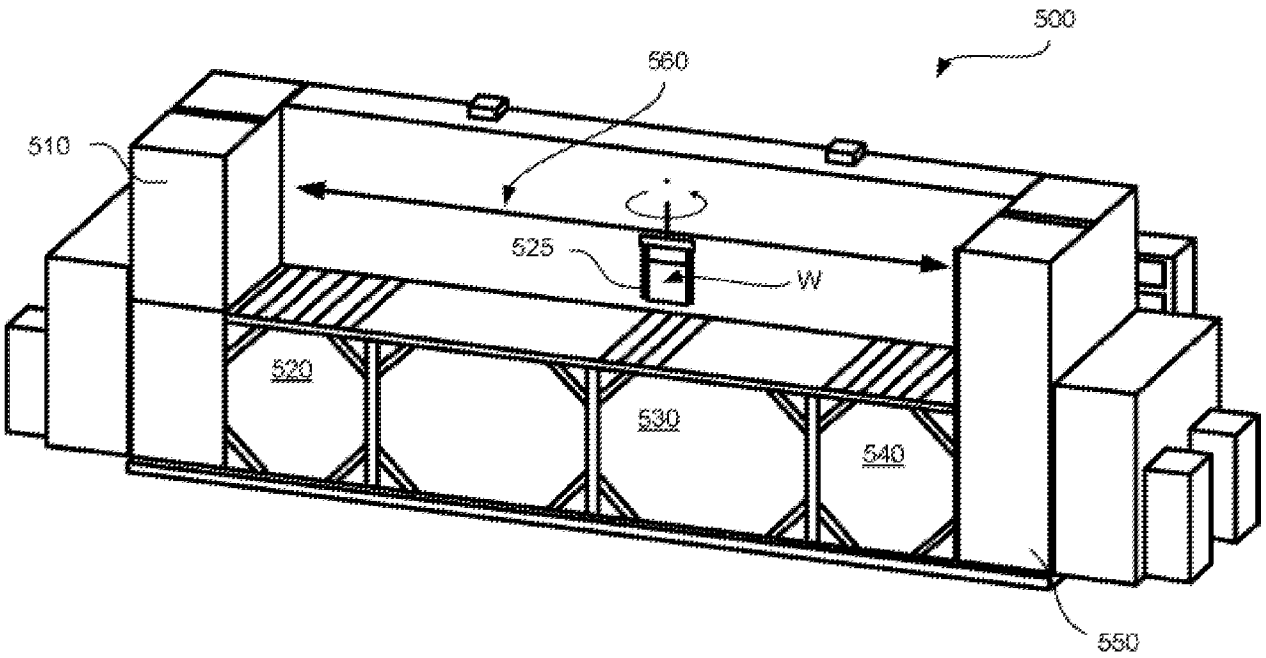
FIG. 2 (Prior art)
FIG. 2 schematically shows a perspective view of the ECD system of FIG. 1.
Figure 3:
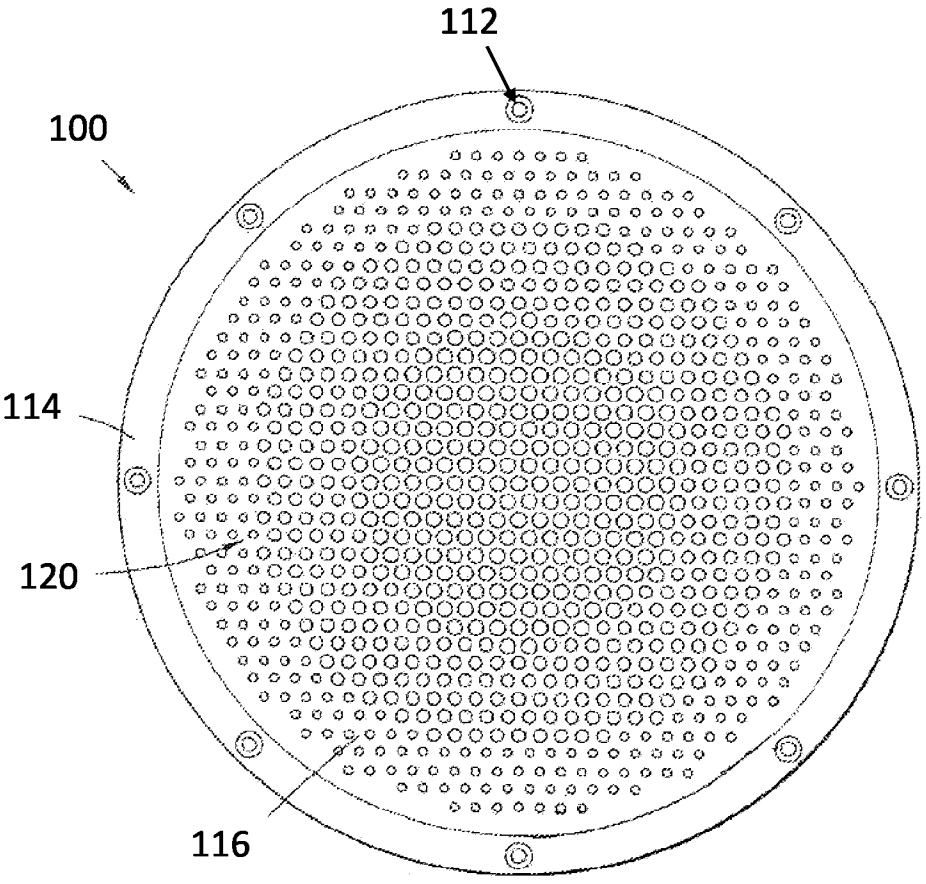
FIG. 3 (Prior art)
FIG. 3 schematically shows a major surface of a known far uniformity shield.
Figure 5:
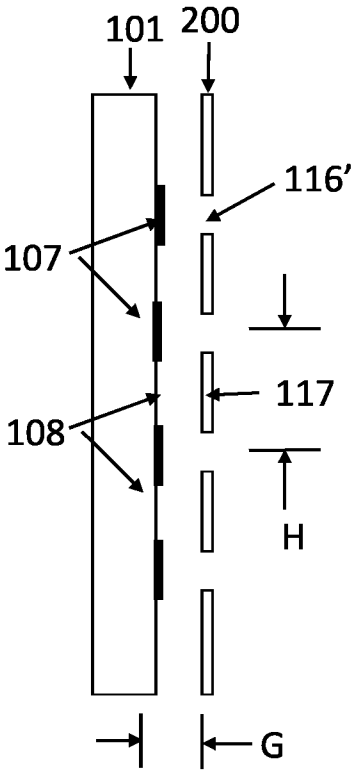
FIG. 5 schematically shows an enlarged, sectional view of a close patterning shield and a workpiece with a non-uniform deposition region.
Figure 4:
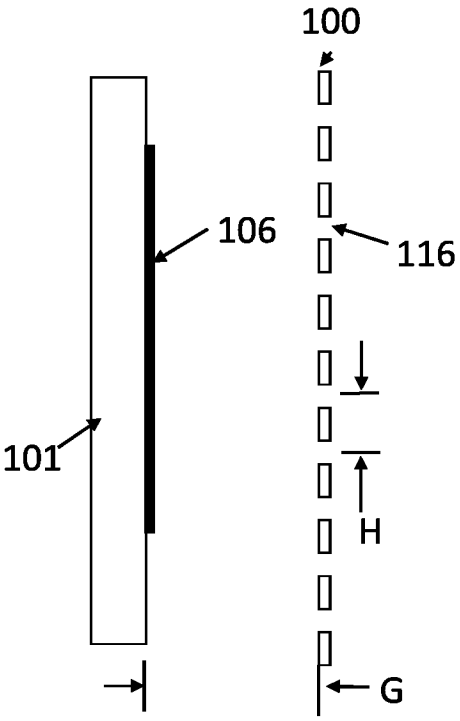
FIG. 4 (Prior art)
FIG. 4 schematically shows an enlarged, sectional view of a far uniformity shield positioned with respect to a workpiece.

FIG. 5 schematically shows an enlarged, sectional view of a "close patterning" shield ("CPS") 200 and a workpiece 101 with a non-uniform deposition region 107. For comparison with the arrangement shown in FIG. 4, the apertures 116' of shield 200 in the extent of shield shown are spaced at a pitch H, while the facing surfaces of shield 200 and workpiece 101 are separated by a gap distance G. Here, the ratio of gap G to spacing H is 0.5. Preferably, G, the distance between facing surfaces of the shield 200 and the workpiece 101 is within the range 2 to 6 mm. Regions 107 on workpiece 101 receive plating current through apertures 116', but gap areas 108 in between regions 107 do not, as current is blocked by shield regions 117. The patterning regime is therefore very different between the far shield technique of FIGS. 2 and 3, and the close shielding technique of FIG. 5.

There are advantages to having a close shield in electroplating. One advantage is the ability to compensate for the current crowding effect, so that sparse and densely populated regions receive appropriate current densities. It is important for the use of a CPS in plating that the shield comprises a substantially planar plate having a pattern of apertures formed therein, the pattern of apertures substantially corresponding to the location of features located on the workpiece in use. The apertures 116 must therefore be properly sized and aligned with features on workpiece 101. Apertures 116 may be of various shapes including round, oval, square or rectangular. The ratio of gap G to opening H for a close shield will be less than 2:1, usually at a gap of approximately 1:1 to achieve improved uniformity compared to a prior art far uniformity shield ("FUS") such as that shown in FIG. 3.

Figure 6:
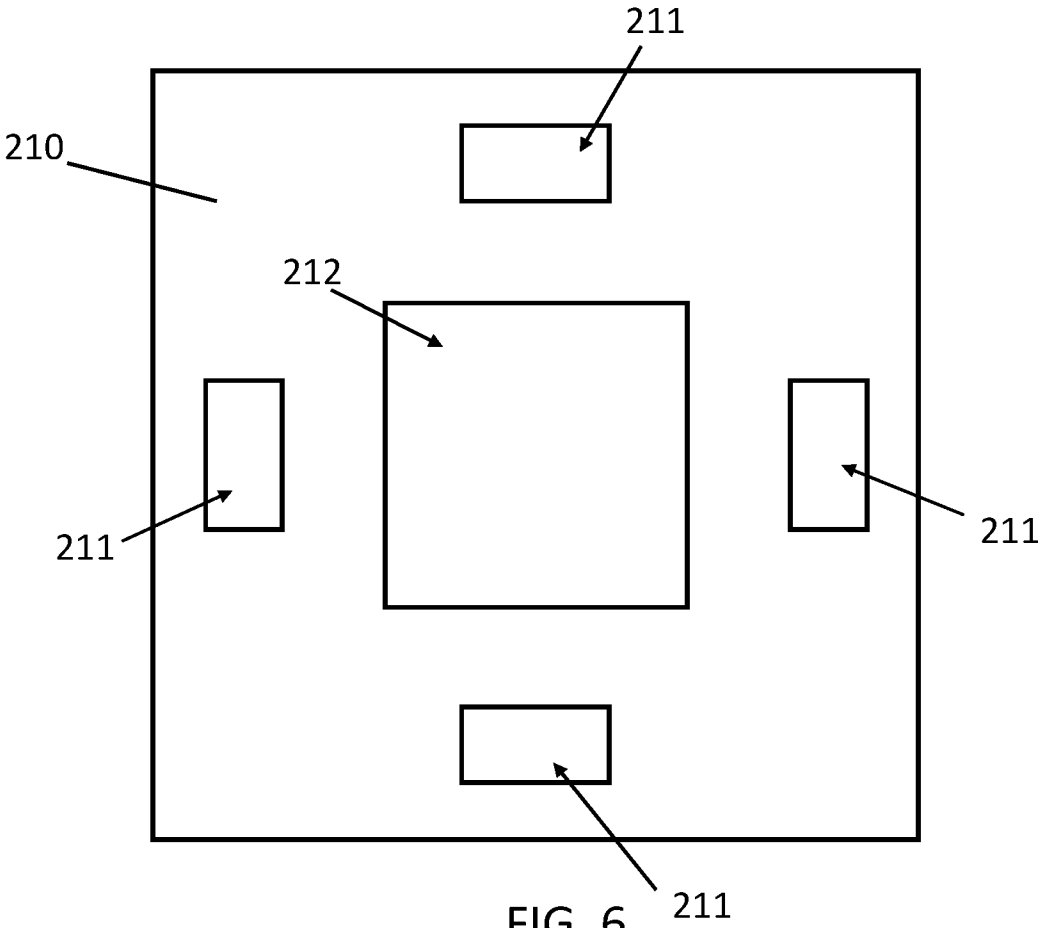
FIG. 6 schematically shows, from above, an exemplary set of feature pattern regions at the die level of a workpiece.

FIG. 6 schematically shows, from above, an exemplary set of feature pattern regions at the die level of a workpiece. A single die 210, here being 50 mm×50 mm, comprises two types of feature pattern regions 211 and 212. The central square region 212 has dimension of 20 mm×20 mm and has relatively sparse pattern features with 30 percent plateable area. The rectangular regions 211 have dimension 5 mm×10 mm and are relatively densely populated with pattern features. The plateable area for regions 211 is 55 percent. The features within regions 211 and 212 may be much smaller than the size of those regions, for example circular openings with diameters in the range of 10-100 um or lines with widths in the range of 2-10 um.

Figure 7:
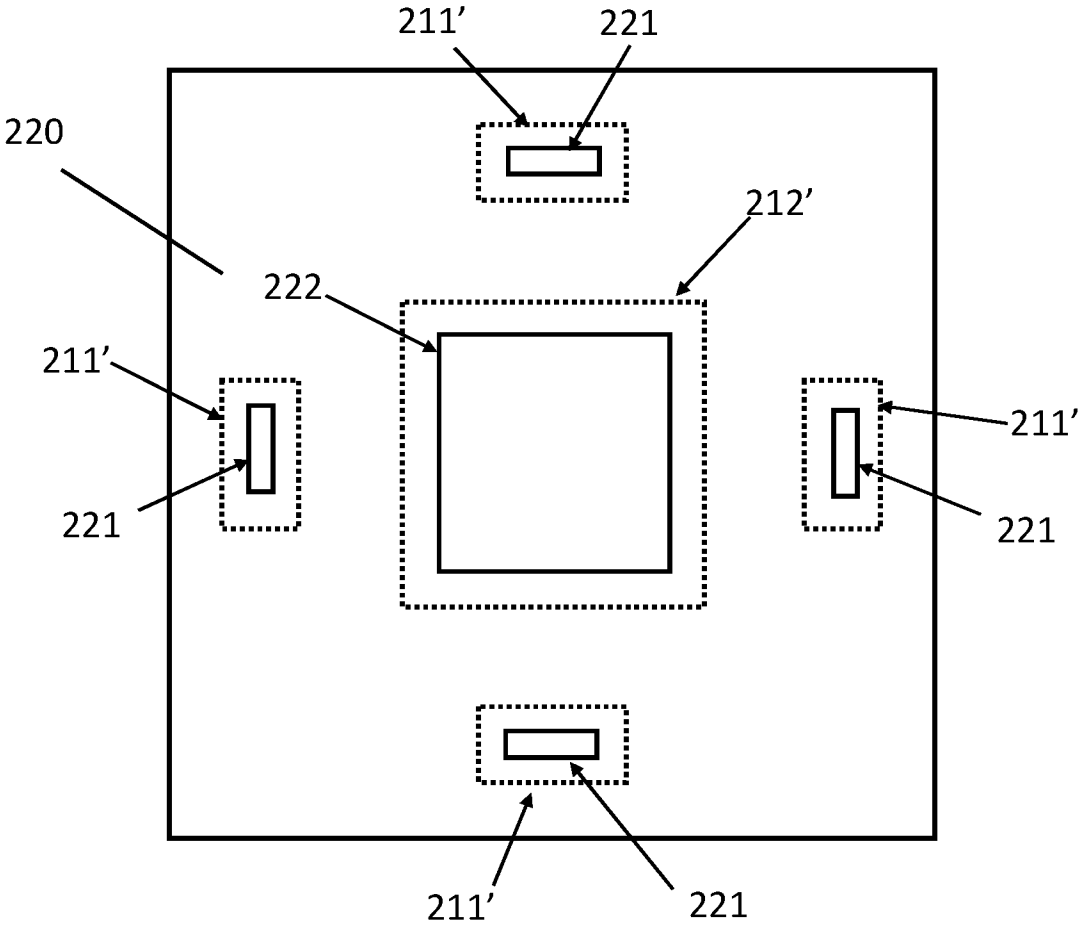
FIG. 7 schematically shows, from above, a portion of a close patterning shield for use with the workpiece of FIG. 6.

FIG. 7 schematically shows, from above, a portion 220 of a substantially planar close patterning shield 200, in the form of a plate, for use with the workpiece of FIG. 6. The CPS portion 220 has apertures 221 and 222 which are optimized for uniform deposition for the workpiece's pattern of interconnect features shown in FIG. 6. Dotted regions 211' and 212' show the size and relative position of the interconnection regions 211 and 212 of die 210 when CPS portion 220 is in alignment with die 210. In this example, the distance between the center of apertures 221 and 222 is 20 mm.

The apertures 221 and 222 are smaller in size than the corresponding pattern regions 211 and 212. The ratio of the opening length to plating region is here referred to as the "shrink factor". For example, if the size of aperture 221 is 2.5 mm×5 mm, and the size of pattern region 211 is 5 mm×10 mm, then the shrink factor is 0.5.

Figure 8B:
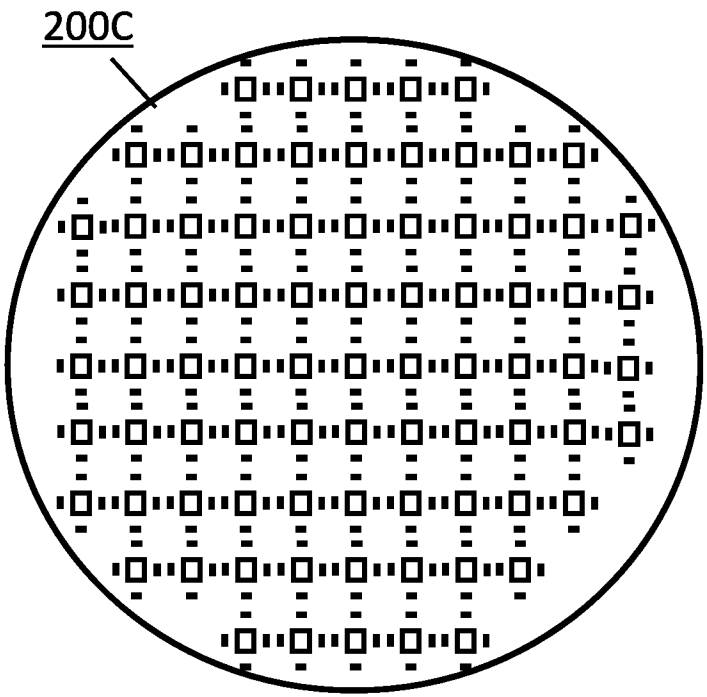
FIG. 8B schematically shows, from above, a circular close patterning shield incorporating the portion of FIG. 7.
Figure 8A:
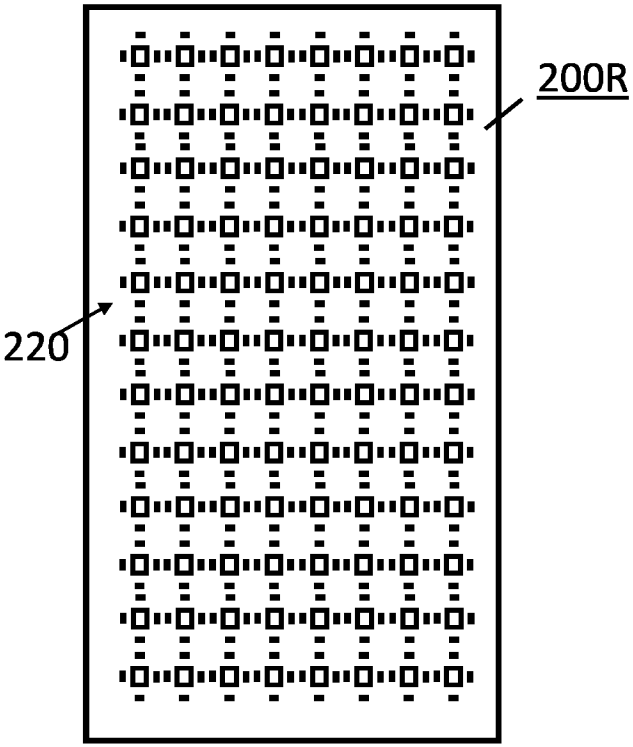
FIG. 8A schematically shows, from above, a rectangular close patterning shield incorporating the portion of FIG. 7.

FIGS. 8A and 8B schematically show, from above, two alternative forms of close patterning shields, i.e. a rectangular and a circular shield respectively, which each incorporate periodically repeating CPS portions 220 such as shown in FIG. 7. It can be seen that in each case, the shield has a pattern of apertures formed therein, the pattern comprising a plurality of sub-patterns (i.e. that arrangement of apertures included in portion 220) which periodically repeat across the planar extent of the shield plate. The period may for example be in the range 5 to 100 mm, in both major directions of the shield, i.e. up-down and left-right as shown in FIGS. 8A, 8B. The rectangular shield 200R shown in FIG. 8A is suitable for plating rectangular workpieces, while the circular shield 200C shown in FIG. 8B is suitable for plating circular workpieces. Each portion 220 or sub-pattern corresponds to one die on corresponding substrate 101. As exemplified in these figures, close positioning shields may be of any shape including rectangular, square, or circular. Although the apertures 221 and 222 shown in these embodiments are rectangular and square, in other embodiments CPS apertures can be of any shape, including for example circular, oval and rectangular.

The CPS 200 pattern of apertures may be designed using electrochemical modeling software which incorporates information about the photoresist feature pattern on workpiece 101, as well as geometric and electrical information about the plating module, to solve for the electric field and deposition rate at the workpiece surface. Geometric features of the plating module incorporated into such software may use CAD models of the anode assembly (such as described below), the shield 200, agitation plates (see below), and any additional electrodes or surfaces which may affect the electric field. Electrical information in such simulations include models for the chemical effects at the anode and workpiece surfaces, the effects of membranes, if present, and the electrical conductivities of one or more plating baths. An example of a modeling software is the Electrodeposition Module of COMSOL Multiphysics, available from COMSOL Inc. of Burlington, Mass. CPS 200 features optimized using such software may include numbers, locations, shapes and sizes of apertures within the shield, as well as shield plate thickness. Plating module features which may be optimized using such software include shield to workplace gap 105 as well as shapes and positions of segmented anodes, membranes, agitation plates, workpiece and shield holders, membranes, module surfaces and any additional electrodes.

Figure 9:
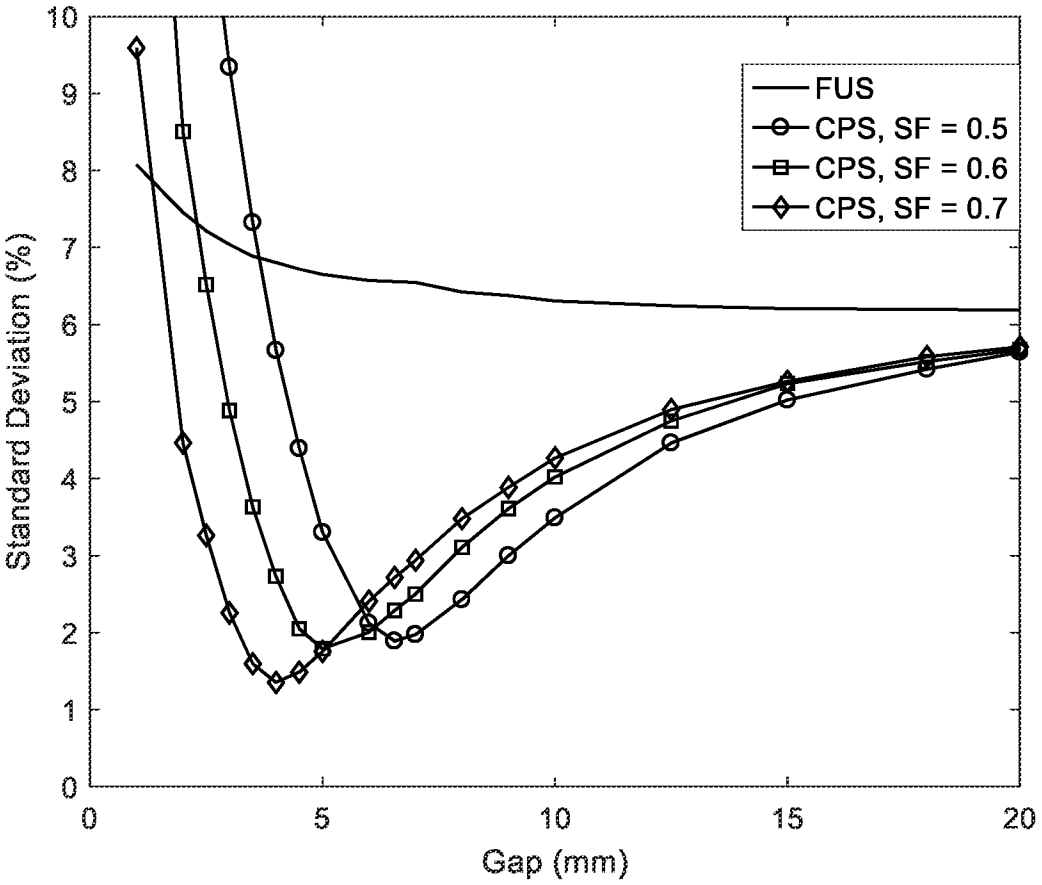
FIG. 9 shows a graph of uniformity versus shield-to-workpiece gap for the sparsely populated interconnect regions of FIG. 6 when using far uniformity and close positioning shields.

FIG. 9 shows a graph of uniformity versus shield-to-workpiece gap G, for the sparsely populated interconnect regions 212 of the die of FIG. 6 when using far uniformity and close positioning shields. The graph shows results of simulations using COMSOL Multiphysics software. The plot ordinate is the normalized standard deviation of plating deposition rate, also known as the one sigma uniformity. Four curves are shown in the plot. The curve labeled "FUS" is the uniformity for a shield with circular openings of diameter 1 mm spaced uniformly on a 2 mm grid. The uniformity for the FUS is in the range of 6.2-8% for gaps of 2-20 mm corresponding to G/H ratios of 1:10. The three curves labeled "CPS" are the uniformity for shields 220, with shrink factors ("SF") of 0.5, 0.6 and 0.7. The graph shows that much better uniformity is achievable with a CPS compared with a FUS. It also shows that the optimum gap depends on shrink factor. For a shrink ratio of 0.7, the optimum gap is 4 mm resulting in a one-sigma uniformity of 1.4%. This uniformity is significantly better than for the FUS.

Figure 10:
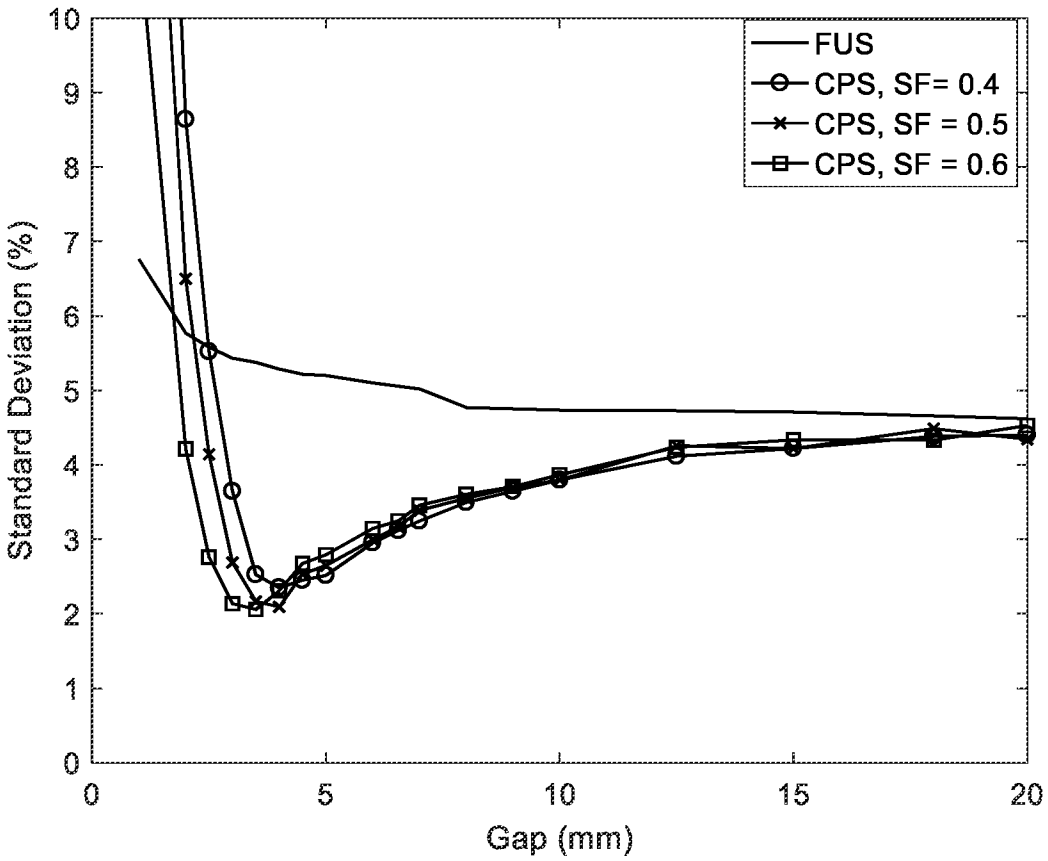
FIG. 10 shows a graph of uniformity versus shield-to-workpiece gap for the densely populated interconnect regions of FIG. 6 when using far uniformity and close positioning shields.

FIG. 10 shows a graph of uniformity versus shield-to-workpiece gap G for the densely populated interconnect regions 211 of the die of FIG. 6 when using far uniformity and close positioning shields. The graph shows results of simulations using COMSOL Multiphysics software. The curve labeled FUS is the normalized standard deviation of bump heights for a shield with circular openings of diameter 1 mm spaced uniformly on a 2 mm grid. The uniformity for the FUS is in the range of 4.5-6.2% for gaps of 2-20 mm corresponding to G/H ratios of 1:10. The optimum shrink factor is 0.6, but uniformity is less sensitive to shrink factor for the dense region than for the sparse regions. At the optimum gap of 4 mm, the G/H ratio for a CPS 200 with the openings shown in FIG. 7 is (4 mm/20 mm)=0.2.

Figure 11:
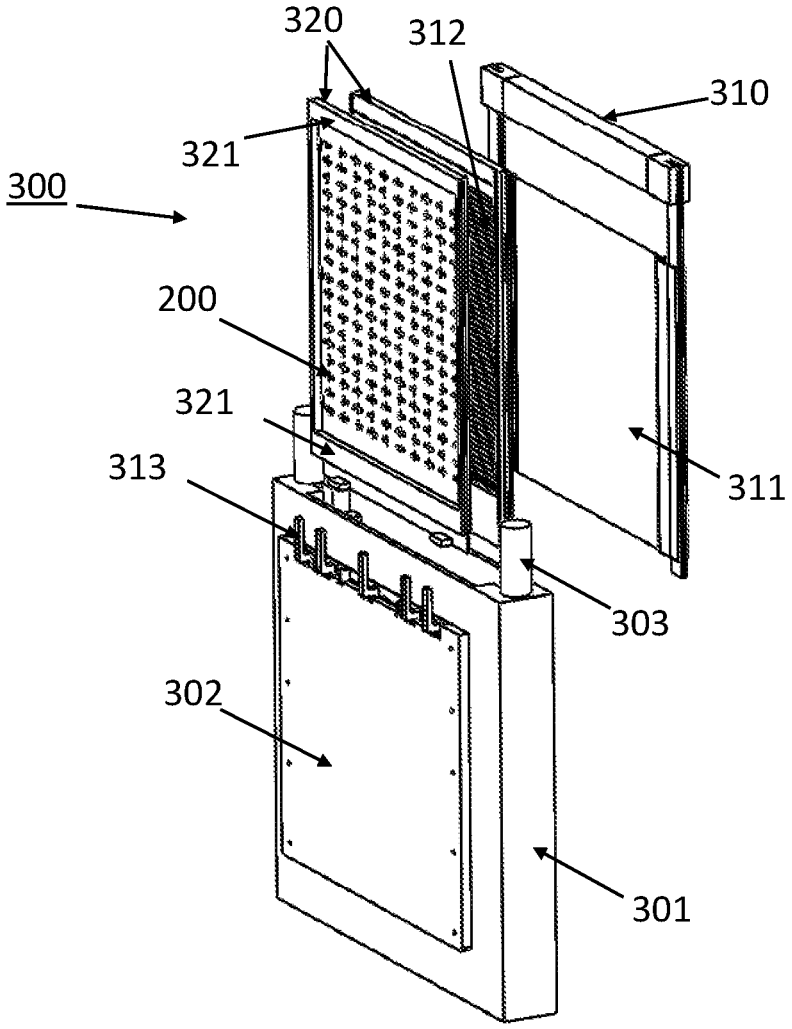
FIG. 11 schematically shows in exploded isometric view a workpiece holder containing a workpiece, cartridges and components of an electroplating module in accordance with an embodiment of the present invention.

FIG. 11 schematically shows in exploded isometric view a workpiece holder containing a workpiece, cartridges and components of an electroplating module of an ECD system in accordance with an embodiment of the present invention. An electroplating module 300 comprises a housing 301 of generally cuboid form with two opposing major surfaces which are substantially parallel to the plane of the workpiece in use, for retaining many of the components of the ECD system, as will be described in more detail below. In particular, the housing 301 houses at least one deposition chamber or plating bath adapted to receive plating solution and, as will be described in detail below, to receive a workpiece 311 held in a first plane by a workpiece holder 310, at least one close patterning shield (CPS) 200 held by a respective shield holder, here cartridge frame 321, in a second plane substantially parallel to the first plane, and an agitation plate 312 having a profiled surface to agitate plating solution in use. As shown, the CPS 200, agitation plate 312 and cartridge frame 321 are assembled together as a cartridge 320 for unitary insertion into and removal from the deposition chamber. At least one additional cartridge may be provided for insertion into and removal from the deposition chamber, and in FIG. 11, two such cartridges 320 are shown.

An anode assembly 302 with multiple segments, powered by associated electrical connections 313, is provided on one or both major external surfaces of the housing 301, which configuration is known in the art.

The module 300 also includes linear motors 303 which are operable to drive agitation plates 312 in a direction parallel to the plane of the workpiece is use, i.e. in the vertical direction as shown in FIG. 11, which operation will be described in more detail below.

It should be noted that the ECD system as a whole may comprise a plurality of such modules 300, as well as transport and control mechanisms for moving workpieces (and their workpiece holders) to the correct module, inserting and removing the same, and exiting the workpiece from the system, in an identical or similar manner to the known system shown in and described above with reference to FIGS. 1 and 2. Such apparatus is known in the art and would be well understood by those skilled in the art, and so such features of these systems need not be discussed in further detail.

Figure 12:
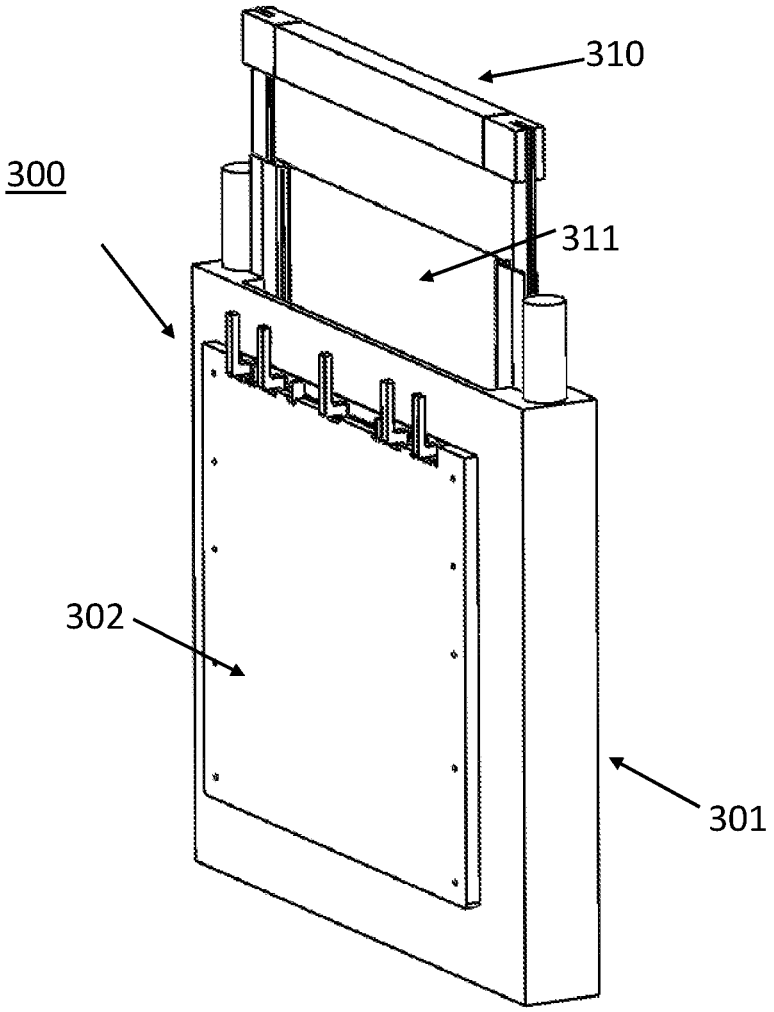
FIG. 12 schematically shows in perspective view the electrochemical plating module of FIG. 11 with a partially inserted workpiece holder.

FIG. 12 schematically shows in perspective view the electrochemical plating module of FIG. 11, in which the workpiece holder 310 and its workpiece 311 are partially inserted into the deposition chamber of the module 300. An exemplary workpiece holder 310 is described in U.S. Pat. No. 10,283,396. Prior to processing, a transport system, such as that shown in and described above with reference to FIGS. 1 and 2, is used to lower workpiece holder 310 into the housing 301. Following electroplating, the transport system is operated to raise the workpiece holder 310 and convey the workpiece holder 310 to other modules (not shown) for further processing, for example to clean and dry the workpiece 311.

Figure 13:
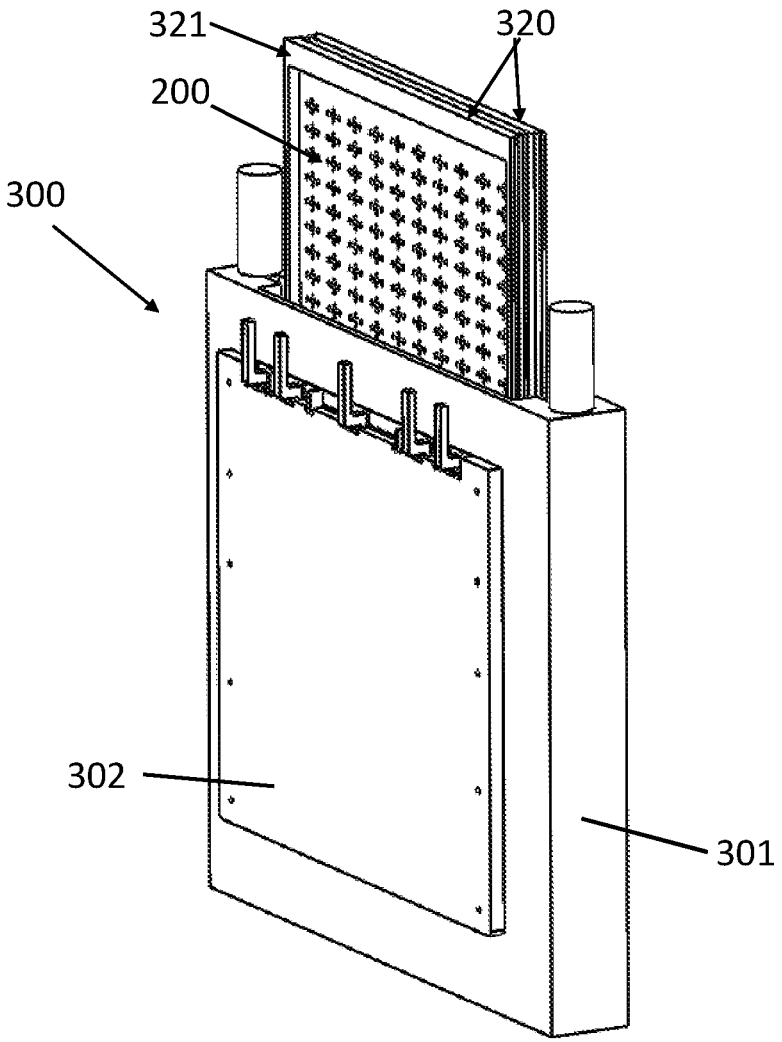
FIG. 13 schematically shows in perspective view the electrochemical plating module of FIG. 11 with a partially inserted cartridge.

FIG. 13 schematically shows in perspective view the electrochemical plating module of FIG. 11, in which each cartridge 320 is partially inserted into the deposition chamber of the module 300. Each cartridge 320 comprises CPS 200, agitation plate 312 and cartridge frame 321 which, in this embodiment, both acts as a shield holder to maintain CPS 200 in a plane substantially parallel to that of the workpiece, and holds a respective agitation plate 312 in parallel alignment therewith during insertion and removal from the deposition chamber.

Figure 14:
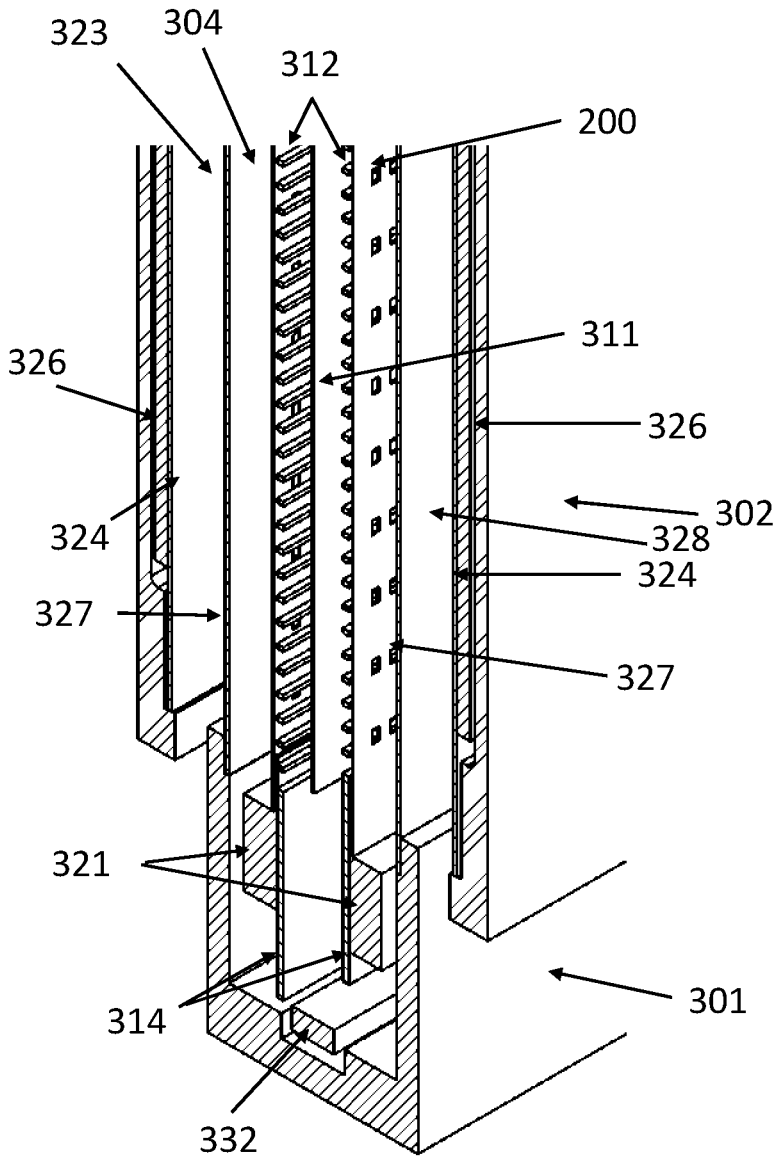
FIG. 14 schematically shows in isometric cross-section view of part of the electrochemical plating module of FIG. 11 with a fully inserted workpiece holder and two cartridges, and showing support features for the cartridges.

FIG. 14 schematically shows in isometric cross-section view a base part of the electrochemical plating module 300 of FIG. 11 with a fully inserted workpiece holder 310 and two cartridges 320, and showing support features for the cartridges. Within each cartridge 320, a base 314 of agitation plate 312 extends downwardly towards the bottom of housing 301, beyond the lowest extent of cartridge frame 321, to an agitation support plate 332. It can also be seen that each anode assembly 302 comprises an anode 324 supported by an anode support 326. Membranes 327, mounted to the housing at their perimeters, separate housing 301 into two compartments, an inner cavity 304 and outer cavity 323, each containing a plating bath with differing chemical composition. Each membrane 327 is held by a membrane support 328. It should be understood that plating on both sides of the workpiece 311 requires two anodes 324, two CPS 200, and two agitation plates 312 as shown. However, in alternative embodiments for single sided plating of workpiece 311, only a single anode 324, CPS 200 and agitation plate 312 is required.

Figure 15:
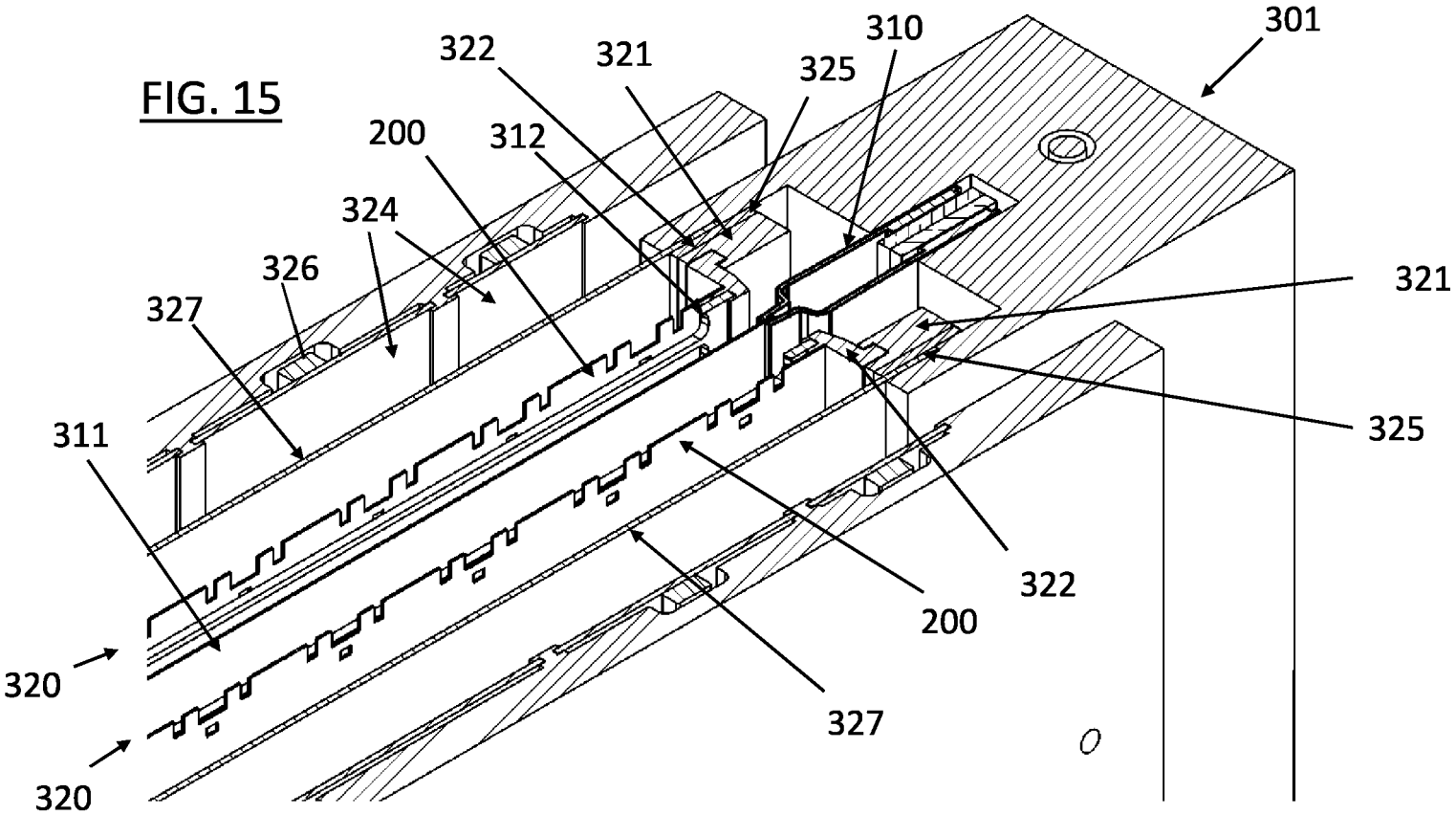
FIG. 15 schematically shows an isometric sectional view of the electrochemical plating module of FIG. 14 showing a workpiece holder and cartridges after insertion.

FIG. 15 schematically shows an isometric sectional view of the electrochemical plating module 300 of FIG. 14 showing workpiece holder 310 and cartridges 320 after insertion. In each cartridge 320, cartridge frame 321 includes mating features which mate with corresponding vertical slotted features of a translation guide 322, which in turn carries the CPS 200 and supports it during insertion. After insertion, the slotted features in guide 322 maintain parallel alignment between CPS 200 and workpiece 311. An actuator 325 is provided at an internal surface of the housing 301, proximate the cartridge frame 321, which is operable to move the cartridge frame 321, translation guide 322, CPS 200 and agitation plate 312 relative to the housing 301, to vary the distance between CPS 200 and workpiece 311. FIG. 15 shows the cartridge 320 in a retracted position, providing sufficient clearance between the agitation plate 312 and workpiece 311 for insertion of workpiece holder 310 into the inner cavity 304 of the deposition chamber while minimising the possibility of interference between agitation plates 312 and workpiece 311. This clearance is especially advantageous in cases where the workpiece 311 is flexible and may be slightly bowed. Actuator 325 may be of pneumatic, mechanical or electrical type, as will be apparent to those skilled in the art.

Figure 16:
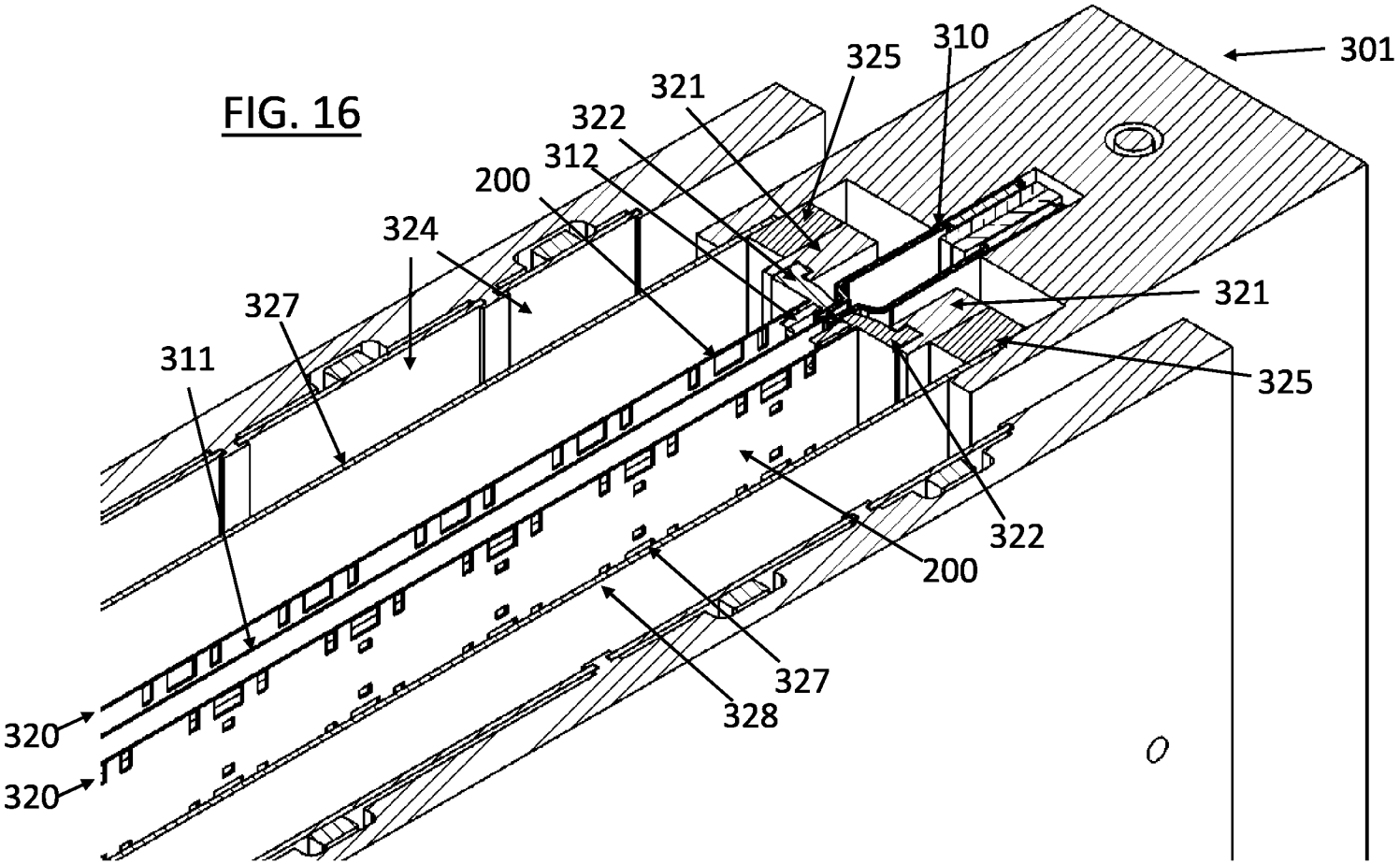
FIG. 16 is a similar view to FIG. 15, following cartridge actuation.

FIG. 16 is a similar view to FIG. 15, following cartridge actuation. Following translation of guides 322 and thus cartridge 320 by actuator 325, CPS 200 is in close proximity to and alignment with workpiece 311. Once cartridge 320 is in this close alignment, current may be provided to workpiece 311 for electroplating. An electrical connection to workpiece holder 310 is established by activation of a contact, which may be done using one or more pneumatic pistons or clamps (not shown) as will be understood to those skilled in the art.

Figure 17:
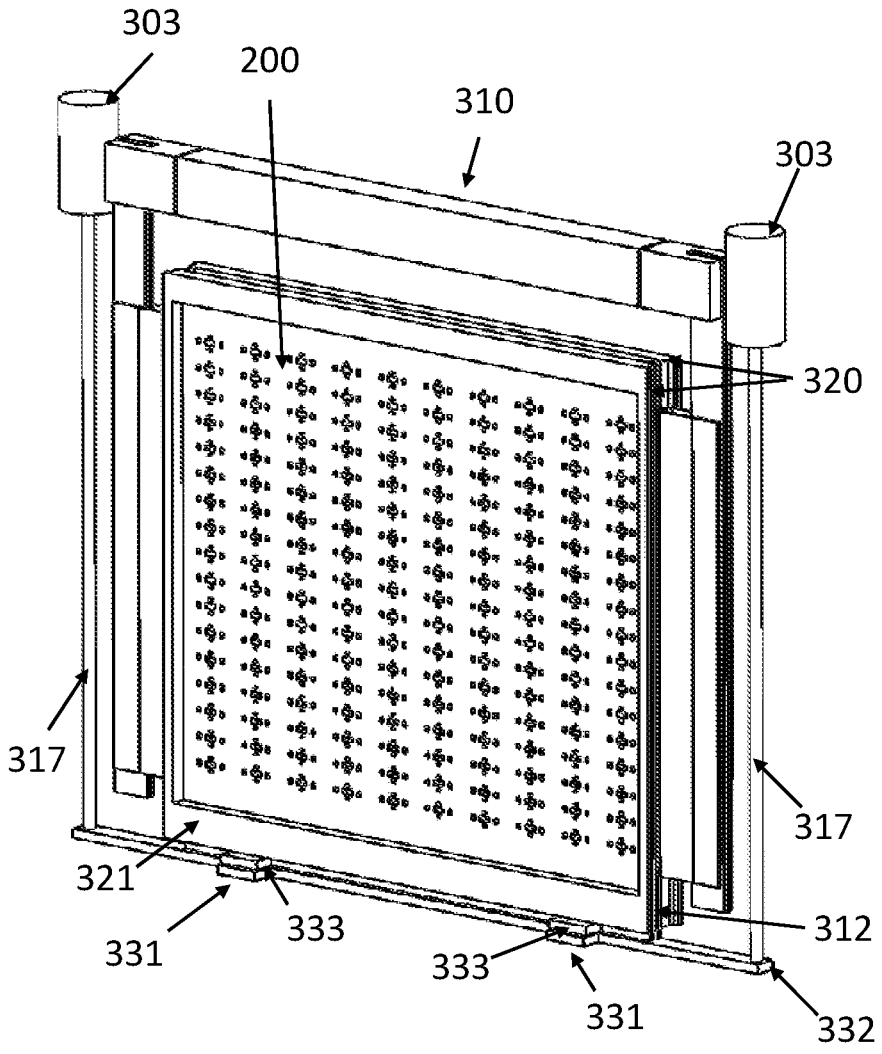
FIG. 17 schematically shows in isometric view the linear motion drive components in relation to the cartridge and workpiece holder of FIGS. 11 to 16.

FIG. 17 schematically shows in isometric view the linear motion drive components in relation to the cartridge 320 and workpiece holder 310 of FIGS. 11 to 16. Linear motors 303 are operable to produce vertical drive motion, which is coupled to an agitation support plate 332 via respective drive shafts 317 which in use extend parallel to, and substantially within, the plane of the workpiece on each lateral side thereof. Agitation support plate 332 is an elongate beam which runs between the distal ends of the two drive shafts 317, and in use applies vertical drive motion to agitation plate 312 via a coupling between a projecting extension 333 of the agitation plate base 314 and a projecting baseplate extension 331 to the agitation support plate 332, the extension 333 and baseplate extension 331 being aligned and adjacent when the cartridge 320 is inserted into the housing 301.

Figure 18:
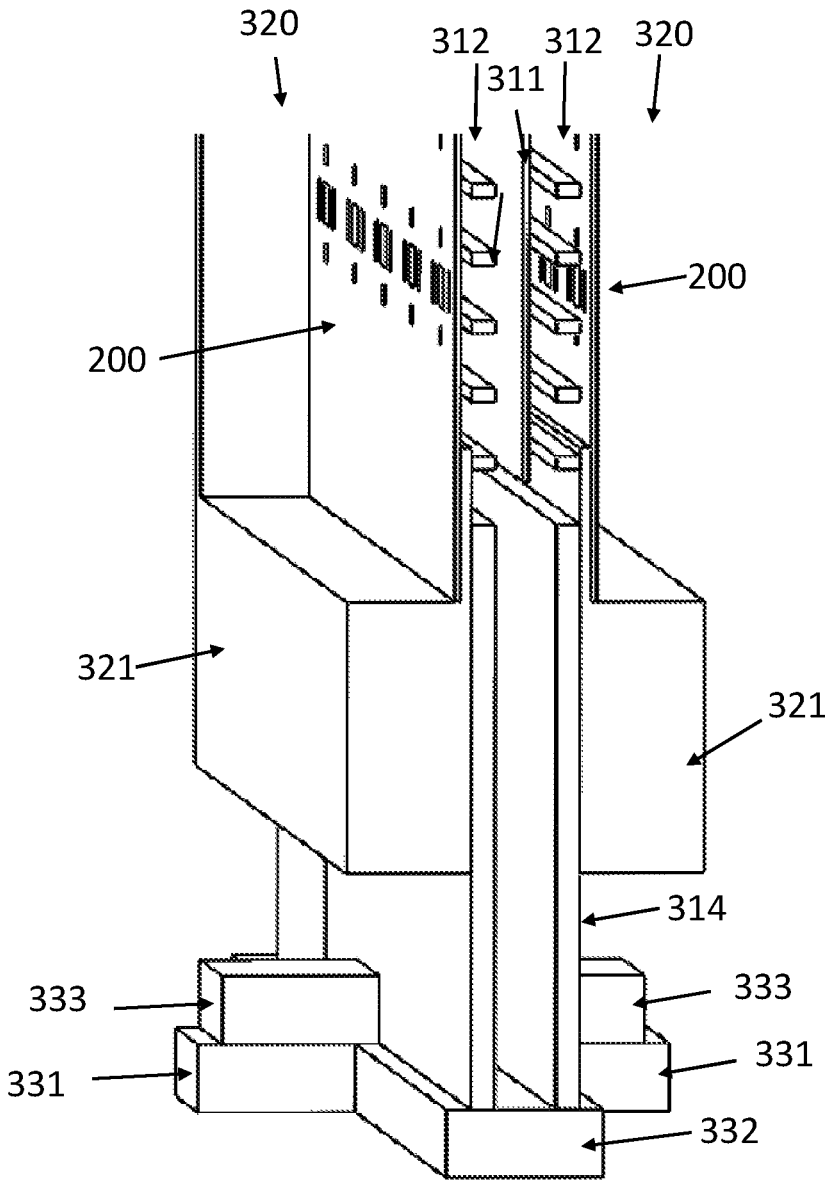
FIG. 18 schematically shows an enlarged isometric view of two cartridges showing linear motion coupling to an agitation plate.

FIG. 18 schematically shows an enlarged isometric view of two cartridges 320 showing linear motion coupling to their agitation plates 312, with each cartridge 320 being inserted into the housing 301, with its respective CPS 200 closely aligned to workpiece 311 and supported by respective cartridge frame 321. The agitation plate base 314 of each agitation plate 312 extends down beyond the respective cartridge frame 321 to abut with the common agitation support plate 332. Agitation support plate 332 couples upward agitation drive force (created by linear motors 303, see FIG. 17) to agitation plate 312. Coupling between agitation plate extension 333 and baseplate extension 331 provides downward agitation drive force to agitation plate 312. The coupling between the agitation plate extension 333 and the baseplate extension 331 may be mechanical or magnetic. In a preferred embodiment the coupling between the agitation plate extension 333 and the baseplate extension 331 is magnetic, which allows transfer of agitation drive force to be self-aligning. Magnets provided in extensions 333 and 331 may be sized so that the coupling force between agitation support plate 332 and agitation plate extension 333 is sufficient to overcome inertial and viscous forces during agitation, but still allows cartridge 320 to be removable by hand.

Figure 19:
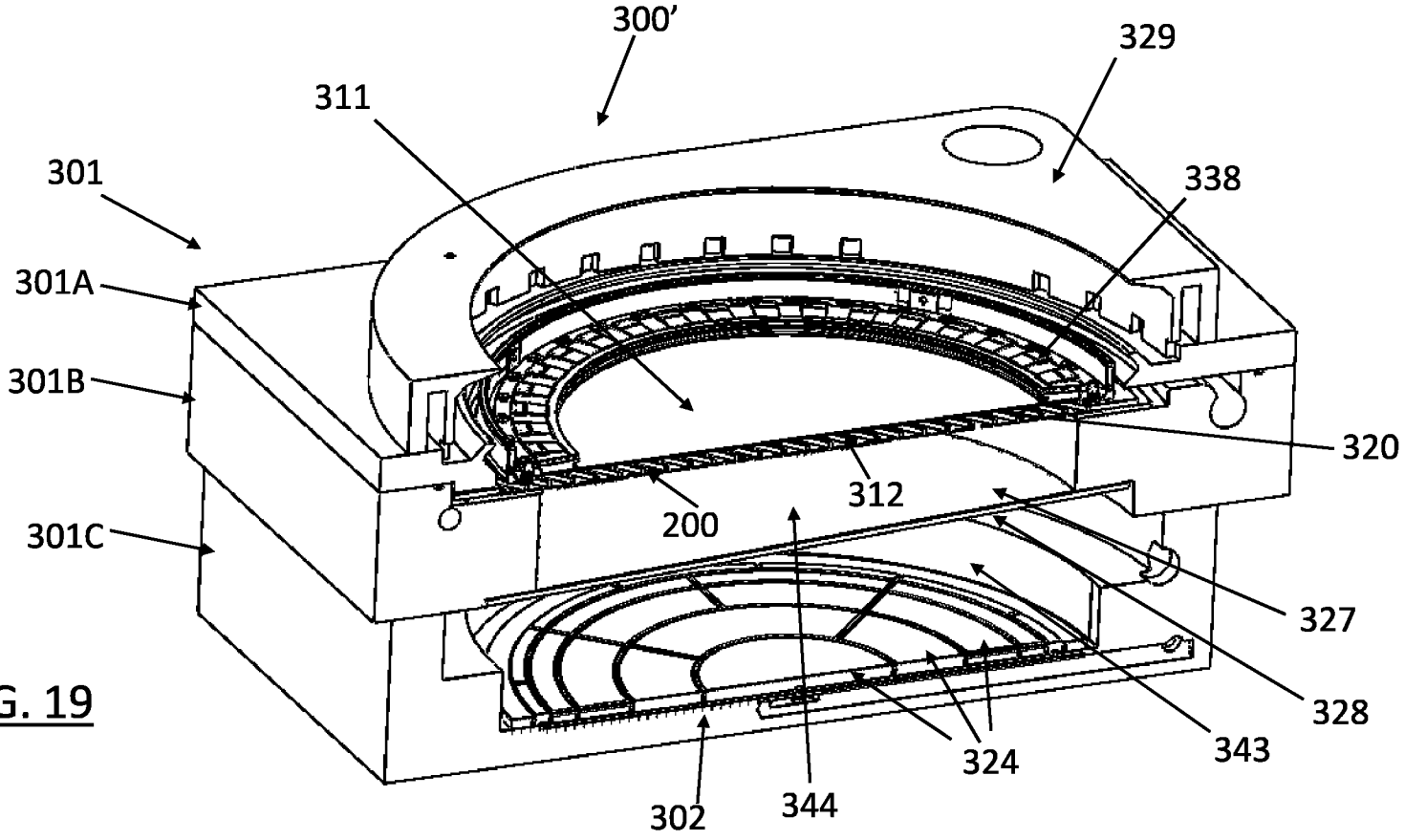
FIG. 19 schematically shows, in section, a top isometric view of a horizontal electrochemical plating module in accordance with another embodiment of the present invention, showing a cartridge with a uniformity shield closely aligned with a workpiece.

FIG. 19 schematically shows, in section, a top isometric view of a horizontal electrochemical plating module 300' in accordance with another embodiment of the present invention, showing a cartridge 320 with a CPS 200 closely aligned with a workpiece 311. Here, the term "horizontal module" means that the planar workpiece 311, as well as the CPS 200 and agitation plate 312, are all retained in the horizontal orientation during deposition, in contrast to the "vertical" apparatus described in FIGS. 11 to 18. For simplicity, an arrangement which only includes a single cartridge 320 is shown, however, and as apparent to those skilled in the art, a two-cartridge configuration, with one cartridge on each side of the workpiece 311, is equally possible.

As shown in FIG. 19, the module 300' is defined by a housing 301 having three housing parts: an upper housing 301A, a center housing 301B and a lower housing 301C, which are provided in a stacked configuration, enclosing a central deposition chamber adapted to receive plating solution in use. The cartridge 320 includes a CPS 200, which as shown is closely aligned with a workpiece 311, and an agitation plate 312. An anode assembly 302 located proximate the base of the module 300', on lower housing 301C, contains a plurality of anode segments 324. A membrane 327, which is held by a membrane support 328, separates plating fluid (plating solution) in a lower cavity 343 within the lower housing 301C from fluid in an upper cavity 344 within the center housing 301B. The cartridge 320 is supported by profile features provided in center housing 301B in order to maintain close alignment with workpiece 311. Workpiece 311 is held by a carrier 338 supported within center housing 301B, which provides both electrical connections and fluid sealing at the edges of the workpiece 311. The upper housing 301A supports an exhaust manifold 329 for spent fluid.

Figure 20:
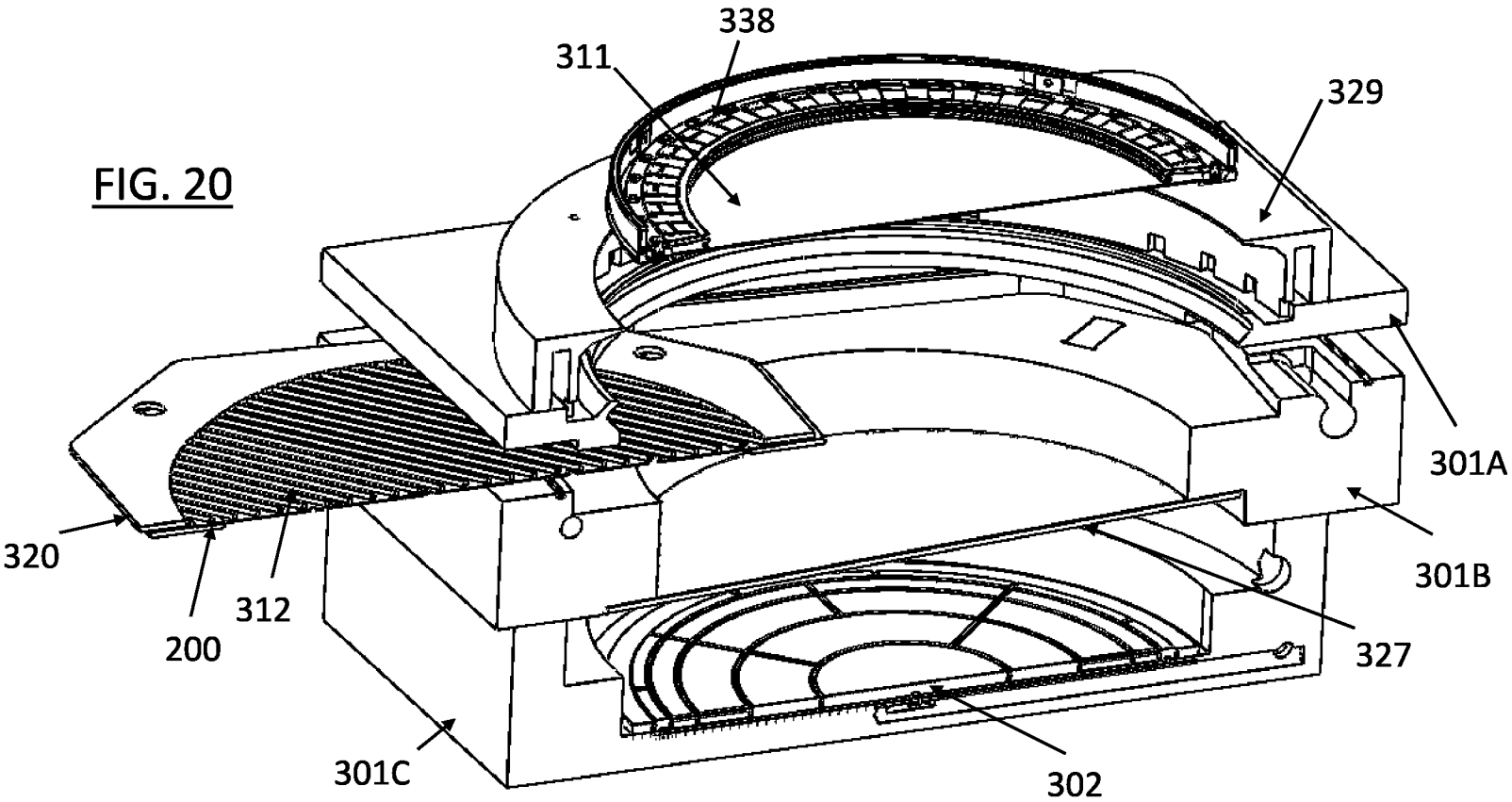
FIG. 20 schematically shows, in section, an exploded isometric view of the module of FIG. 19, with a cartridge partially inserted.

FIG. 20 schematically shows, in section, an exploded isometric view of the module 300' of FIG. 19, with cartridge 320 partially inserted. As shown, cartridge 320 is insertable between the upper housing 301A and center housing 301B. Upper housing 301A may for example be vertically actuated to provide sufficient clearance to allow insertion of cartridge 320, or in alternative embodiments (not shown) an actuator may open the upper housing 301A relative to the center housing 301B, for example in a clam-shell manner, to accept cartridge 320. In all embodiments, once the cartridge 320 is inserted into the deposition chamber, the actuator will operate to reduce the relative distance between the workpiece holder and shield holder.

The above-described embodiments are exemplary only, and other possibilities and alternatives within the scope of the invention will be apparent to those skilled in the art.

REFERENCE NUMERALS USED

100—Far uniformity shield
101—Workpiece
106—Workpiece region
107—Areas
108—Gap areas
112—Fastening holes
114—Outer ring
116, 116'—Apertures
117—Shield regions
120—Planar body
200—Close patterning shield (CPS)
220—Shield portion
300—Module
300'—Horizontal module

301—Housing
301A—Upper housing
301B—Central housing
301C—Lower housing
302—Anode assembly
303—Linear motor
304—Inner cavity
310—Workpiece holder
311—Workpiece
312—Agitation plate
314—Agitation plate base
313—Electrical connections
320—Cartridge
321—Cartridge frame
322—Translation guide
323—Outer cavity
324—Anode
325—Actuator
326—Anode support
328—Membrane support
329—Exhaust manifold
331—Baseplate extension
332—Agitation support plate
333—Agitation plate extension
343—Lower cavity
344—Upper cavity
338—Carrier
G—Gap distance
H—Aperture spacing
500—Known ECD system
510—Loader module
512—Load/input stage
515—Process path
520—Pre-processing modules
525—Workpiece holder
530, 532, 534, 536, 538—Processing modules
540—Post-processing modules
550—Unloader module
555—Return path
560—Chemical management system
570—Electrical management system
PH—Panel holder

The invention claimed is:

1. An electrochemical deposition system for depositing metal onto a deposition region of a workpiece, comprising:

a deposition chamber adapted to receive plating solution in use, a workpiece holder for holding a workpiece in a first plane, a shield, a shield holder for holding the shield in a second plane substantially parallel to the first plane facing the deposition region in use, the shield holder separating the shield and deposited material on the workpiece by a gap distance of more than one millimetre during deposition, wherein the shield comprises a substantially planar plate having a pattern of apertures formed therein, the pattern of apertures substantially corresponding to a location of features located on the workpiece during deposition, an agitation plate having a profiled surface to agitate plating solution in use, wherein the workpiece holder, shield holder and agitation plate are all adapted for insertion into and removal from the deposition chamber, wherein the electrochemical deposition system further comprises an actuator operable to change a relative distance between the workpiece holder and shield holder, and hence the gap distance between the shield and the deposited material on the workpiece during deposition, in a direction normal to the first and second planes, while they are located within the deposition chamber, and wherein the agitation plate and shield holder are assembled together as a cartridge, for insertion into and removal from the deposition chamber.

2. The system of claim 1, wherein the agitation plate is mounted on the shield holder.

3. The system of claim 2, wherein the agitation plate is movably mounted on the shield holder, to permit relative motion therebetween, in a direction parallel to the first plane.

4. The system of claim 1, comprising at least one additional cartridge for insertion into and removal from the deposition chamber.

5. The system of claim 1, wherein the pattern comprises a plurality of sub-patterns which periodically repeat across the planar extent of the plate.

6. The system of claim 5, wherein the period is in the range 5 to 100 mm.

7. The system of claim 1, wherein the actuator is operable to change the relative distance between the workpiece holder and shield holder so that facing surfaces of the shield and the workpiece are brought within a gap distance ranging from 2 to 6 mm within the deposition chamber in use.

8. The system of claim 1, wherein the actuator comprises one of the group consisting of electrical actuators, pneumatic actuators and hydraulic actuators.

9. The system of claim 1, comprising an agitation actuator, the agitation actuator being operatively connected to the agitation plate when it is inserted in the deposition chamber, for effecting reciprocal linear motion of the inserted agitation plate in a direction parallel to the first plane.

10. The system of claim 9, comprising a coupling between the agitation plate and the agitation actuator, the coupling engaging when the agitation plate is inserted into the deposition chamber and disengaging when the agitation plate is removed from the deposition chamber.

11. The system of claim 10, wherein the coupling comprises a magnetic coupling.

12. The system of claim 1, wherein the agitation plate is located between the shield holder and the workpiece holder.

13. A cartridge for use in an electrochemical deposition system for depositing target material onto a deposition region of a workpiece, comprising:

an agitation plate having a profiled surface to agitate a liquid in use, a shield comprising a substantially planar plate having a pattern of apertures formed therein, the pattern of apertures substantially corresponding to a location of features located on the workpiece during deposition, and a shield holder that holds the shield facing the deposition region in use and separates the shield from deposited material on the workpiece by a gap distance of more than one millimeter during deposition.

14. The cartridge of claim 13, wherein the pattern comprises a plurality of sub-patterns which periodically repeat across the planar extent of the plate.

15. The system of claim 14, wherein the period is in the range 5 to 100 mm.

16. The cartridge of claim 13, wherein the agitation plate is located between the shield holder and the workpiece.

17. A system for electrochemical deposition comprising: a deposition chamber and the cartridge of claim 13 removably received in the deposition chamber.

* * * * *